US005160055A

United States Patent [19]

Gray

[11] Patent Number: 5,160,055

[45] Date of Patent: Nov. 3, 1992

[54] LOAD MOMENT INDICATOR SYSTEM

[75] Inventor: Gregory G. Gray, Hagerstown, Md.

[73] Assignee: JLG Industries, Inc., McConnellsburg, Pa.

[21] Appl. No.: 769,783

[22] Filed: Oct. 2, 1991

[51] Int. Cl.[5] ..... B66C 13/48

[52] U.S. Cl. ..... 212/150; 212/155

[58] Field of Search ..... 212/153, 154, 155, 156, 212/157, 158; 340/685, 150

[56] References Cited

U.S. PATENT DOCUMENTS

| | | | |
|---|---|---|---|
| 2,477,854 | 8/1949 | Baker | 265/47 |
| 2,616,683 | 11/1952 | LeFevre, Jr. | 265/27 |
| 3,339,652 | 9/1967 | Price | 177/136 |
| 3,638,211 | 1/1972 | Sanchez | 212/154 |
| 3,641,551 | 2/1972 | Sterner et al. | 340/267 |
| 3,680,714 | 8/1972 | Holmes | 212/154 |
| 3,713,129 | 1/1973 | Buchholz | 212/154 |
| 3,724,679 | 4/1973 | Brownell et al. | 212/39 MS |
| 4,003,487 | 1/1977 | Downing | 214/673 |
| 4,039,084 | 8/1977 | Shinohara et al. | 212/39 MS |
| 4,042,135 | 8/1977 | Pugh et al. | 214/141 |
| 4,058,178 | 11/1977 | Shinohara et al. | 177/146 |
| 4,185,280 | 1/1980 | Wilhelm | 340/685 |
| 4,222,491 | 9/1980 | Geppert | 212/153 |
| 4,395,706 | 7/1983 | Garber | 212/154 |
| 4,752,012 | 6/1988 | Juergens | 212/154 |

*Primary Examiner*—Jesus D. Sotelo
*Assistant Examiner*—Stephen P. Avila
*Attorney, Agent, or Firm*—Foley & Lardner

[57] ABSTRACT

A load moment indicator system for lift equipment, the system including a sensor embedded in a solid portion of the piston rod of the lifting cylinder of the equipment for generating a signal which is indicative of the load being lifted. A stored value representing the maximum load lifting capacity of the lift equipment for a particular load zone is then compared to the actual load signal, and where the actual load approaches or exceeds the maximum load lifting capacity, alarm signals are activated and/or the operating functions creating the overload incapacitated.

17 Claims, 2 Drawing Sheets

LOAD MOMENT INDICATOR SYSTEM

BACKGROUND OF THE INVENTION

1. Field of the Invention

This invention relates to a load moment indicator system for a material handling device attached to a boom, and more particularly to a load moment indicator which warns the operator when the maximum load lifting capacity is being or has been reached, so that toppling or structural failure is avoided. It will be understood that depending on design, certain equipment will structurally fail before toppling, and vice versa.

Although the following description is with reference to a truck mounted crane where the load is transferred to the boom via a load line, the invention has application in other material handling apparatus having load lifting means where maximum load lifting capacity is a concern. The invention concepts can be used, for example, in fork lift trucks, personnel lift or work platforms, grapples, augers, clamshells or buckets, electromagnet attachments fixed to the load, etc. Similarly, the invention applies to self-propelled and non-self-propelled machines with or without outriggers, machines having fixed or telescoping booms, and machines having more than one lift cylinder, for example, articulating booms or booms having dual lift cylinders. Sensors in accordance with the invention can thus be installed in any cylinder supporting the structure and thus the load. For example, a linear actuator or a cylinder which is pneumatically actuated could also utilize the strain sensor of the present invention.

2. Description of the Related Art

In a crane installed on a base, as for example a truck, there is always a concern that if too great a load is lifted, the crane will topple over due to the large moment created around the axis of rotation of the crane boom, or the crane will structurally fail. The moment created is a function of the boom length, the boom angle, and the load being lifted. As might be expected, where a telescopic boom is used, the moment created during the lifting of a particular load can change quite rapidly as the boom is telescoped inwardly or outwardly, while simultaneously being rotated about its axis and thereby changing the boom angle.

Accordingly, it is very important that the crane operator be aware of these parameters in order to ensure that the crane does not exceed maximum lifting capacity. In order to assist the crane operator in performing this function, a number of indicator systems have been created to help identify when a critical crane configuration is reached. These indicator systems are commonly referred to as Load Indication Systems, Overload Protection Devices, Safe Load Indicators, Rated Capacity Indicators, and Load Moment Indicator (LMI) Systems.

The above systems generally consist of some but not always all of the following: means for detecting the weight of the load being lifted, means for determining the boom length and angle, and means providing rotational information. All of these factors should take into account all permissible loads on the system but, as above noted, the computation of maximum loads on a continuous basis is difficult to accomplish even with sophisticated programming.

In theory, based on the boom length and angle information, a load radius from the center line of the rotation of the boom to the hook block can be calculated. A load chart is then created which shows a maximum lifting capacity for each configuration of a particular load radius and boom length. Therefore, by comparing the weight of the actual load being lifted with the maximum lifting capacity for the appropriate crane, a crane operator can determine if that capacity is being reached or exceeded and take corrective action to preclude the toppling over or structural failure of the crane.

In Load Indication Systems, the crane operator must determine the crane configuration and then go to the load chart to determine the maximum lifting capacity. This manual process takes a great deal of time, relies heavily on the operator, and is not very useful in situations where the crane configuration is rapidly changing. In LMI systems, on the other hand, the crane configuration is automatically determined, and the maximum lifting capacity based on that configuration calculated on a continuing basis. However, calculating the load on a continuous basis for every point in space in terms of maximum lifting capacity creates a computational load which is difficult to manage.

Currently, a majority of the LMI systems commercially available use either pressure sensors in the lift cylinder, a tensiometer in the load line, a chain link style load cell at the dead end of the load line, or a boom lifting cable. Other LMI systems utilize either a sheave pin style load cell, or a shackle style load cell to measure the load. The last two load measuring techniques are most prevalent in systems that provide a read out of the weight of the load. Each of the above-mentioned techniques for measuring load has a number of disadvantages which will be described hereinbelow.

In most telescoping booms, at least one cylinder is used to raise and lower the boom. Thus, measuring the load as it is transferred down through the cylinder is a commonly known technique. In this system, a pressure transducer or transducers are attached to the cylinder to measure the pressure within the cylinder. At first, these systems only measured the pressure on the piston side of the cylinder. This proved unacceptable for two reasons. First, every maximum lifting capacity as determined by the load chart does not cause the same pressure to be generated in the lift cylinder. Secondly, moving the boom with a load suspended in the air generates significantly different pressures then when the boom is held stationary and the load is lifted with the winch.

The first problem can be resolved by adding length and angle sensors to the crane, and using the inputs from those sensors to determine a maximum lifting capacity for a particular machine configuration. However, the solution to the second problem has been more elusive. In many of the pressure sensing systems, a second pressure sensor on the rod side of the hydraulic cylinder is employed. Subtracting the rod side signal from the piston side signal would, in theory, eliminate the error. However, this solution cannot correct the non-linearities created by the movement of the piston head in the cylinder. Friction, unequal volumes of oil, and oil viscosity changes all contribute to the non-linearities. In addition, having two sensors doubles the possibility of sensor error and increases the number of system components that can fail. Finally, another drawback of the above load sensing system is that the pressure must be sensed on the cylinder side of the safety holding valves. This creates the possibility that an uncontrolled descent of the boom may occur if the hydraulic line or sensor is damaged.

A tensiometer operates by passing the load bearing cable through a series of sheaves which are designed to measure the force applied to the middle sheave. Based on this information, the weight of the load being lifted can be determined. Tensiometers have three major shortfalls. First, the load bearing cable reacts to the load being applied just like a spring would. Thus, a lag time associated with calculating the load is increased every time the load line passes over a cable sheave. As the number of sheaves is increased, the lag time in determining the load is also increased. Secondly, the tension in the section of the cable which is being measured by the tensiometer is dependent on the number of lines which are reeved around the hook block and the sheaves. The system is thus dependent on the operator to input the correct configuration of the hook block and sheaves. If the operator makes a mistake, he will get erroneous data. Thus, the potential for exceeding the maximum lifting capacity of the crane, without receiving a warning, exists. Finally, when using a tensiometer, every time a cable passes around a sheave it causes wear and tear on the cable and therefore reduces the expected life of the cable.

Load shackles are heretofore probably the most accurate method for determining the load being lifted by a crane. However, since the load shackle is connected to the hook of the crane, it is extremely difficult to get the signal generated by the load shackle back to the operator. Radio transmission is the only practical solution to this problem, but this is a prohibitively expensive design option for an LMI system. In addition, the shackle also increases the overall length of the hook block assembly.

Chain link style load cells are often the method of choice for lattice boom cranes. However, most other crane styles do not have a place in the structure where a load bearing cable is terminated unless an even number of lines are used with the hook block. For telescopic cranes, the chain link style load cell is not practical for two reasons. First, the number of parts of line which are reeved through the hook block are constantly being changed by the operator in the field to correspond to the load being lifted. Accordingly, if the number of parts of line are not an even number, the load bearing cable will not have a termination point, and the chain link style load cell cannot be used. Secondly, even if the chain link style load cell were used, it would be prohibitively expensive to get the signal from the load cell from the end of the telescoping boom to the operator.

Load pins are transducers which are designed to measure the forces being transferred through the pin. They are most effective when used with cable sheaves. The sheaves tend to equalize the torsional forces that would otherwise cause a large hysteresis if, for example, the load pin was used as one of the load bearing cylinder pins. Load pins face the same problem as the load shackle and chain link style load cells in that it is prohibitively expensive to transmit the signal from the load pin down a telescoping boom to the operator.

Microcell sensors are also available for measuring the load. However, these microcells are designed to be applied to the outside of a structure and exposure to the environment is unavoidable. In particular, these microcells are very sensitive to changes in temperature, especially changes which are caused by exposure to direct sunlight. Accordingly, in the crane environment, the use of microcells can produce unreliable weight indications.

In U.S. Pat. No. 4,039,084, the stress in a crane lifting hydraulic cylinder is determined by four strain sensors which are mounted on the exterior of the hydraulic cylinder piston rod or on a supporting means attached to the end of the piston rod. The problems with this device are that a plurality of sensors are required and each of the sensors is mounted such that they are exposed to the environment. Thus, continued exposure to rain, snow and sunlight can deteriorate the its sensing capabilities. In addition, when the sensors are exposed to direct sunlight, the temperature difference between the sensor and its surrounding environment can also result in erroneous sensor indications.

SUMMARY OF THE INVENTION

It is an object of the present invention to provide an LMI system which indicates when a load being lifted by a crane exceeds a predetermined percentage of the maximum load lifting capacity for a specific crane configuration.

It is also an object of the invention to provide a load moment indicator which is not susceptible to erroneous indications due to the non-linearities which occur in a crane's hydraulic lifting cylinder.

Yet another object of the invention is to provide a load moment indicator which indicates the weight of a load being lifted without any lag time associated therewith.

Still another object of the invention is to provide a load moment indicator having a simplified and economical means for transmitting a load indicative signal.

Another object of the invention is to provide a load moment indicator having a weight detection device which is environmentally protected and which is less susceptible to error due to temperature gradients between the sensor and the surface it is mounted upon.

Yet another object of the invention is to provide a load moment indicator which classifies crane configuration into discrete load zones, with each load zone having a maximum lifting capacity associated therewith.

Still another object of the invention is to provide a load moment indicator system which disables the operating functions of the crane when the maximum lifting capacity is exceeded.

The above objectives are met by an LMI system having a means for generating a first signal which is indicative of the angle between the crane boom and the crane base, a means for generating a second signal which is indicative of the boom length, and a strain sensor embedded in the piston rod of the crane's hydraulic lifting cylinder for generating a third signal which is indicative of the load being lifted by the crane. The system also determines a maximum load lifting capacity based on the first and second signals and compares this value to the weight associated with the third signal to determine the percentage relationship between these two values.

BRIEF DESCRIPTION OF THE DRAWINGS

Other objects, features, and advantages of the present invention will become apparent from the following detailed description and accompanying drawings wherein.

DETAILED DESCRIPTION OF THE PREFERRED EMBODIMENTS

Figure 1:
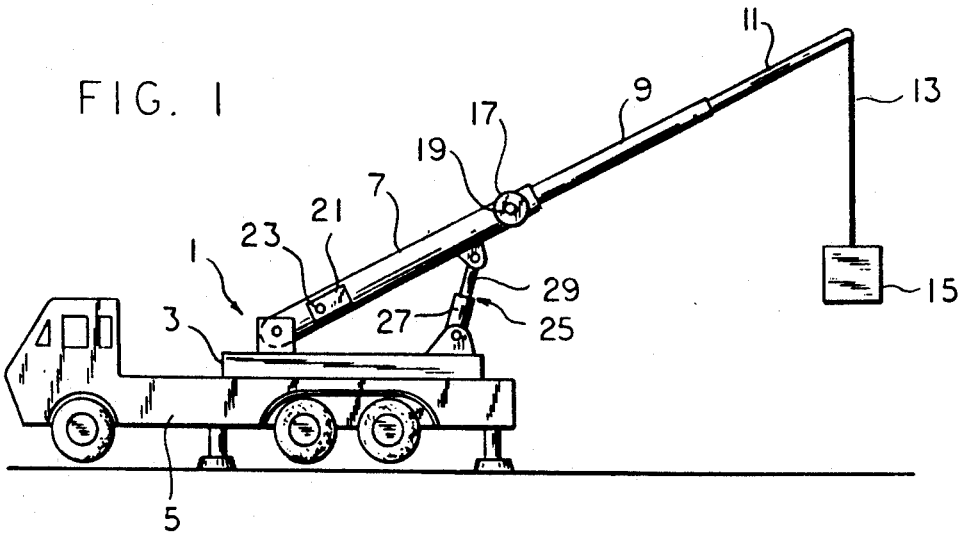
FIG. 1 is an elevational side view of a crane with a telescopic boom incorporating an embodiment of the load moment indicator system according to the present invention.

FIG. 1 illustrates, by way of example, the invention utilized in a truck mounted crane, although various other types of apparatus could also utilize the invention concepts, as noted above. In FIG. 1, a crane 1 has a base portion 3 connected to a truck body 5. The crane 1 has a base boom member 7 and two telescopically extensible boom members 9, 11. A load bearing cable 13 is suspended from the boom member 11 and is attached to a load Base boom member 7 has a cable reeling drum 17 mounted thereon. The cable reeling drum 17 has a cable length sensor 19 mounted on it which generates a signal that corresponds to the overall length of boom members 7, 9, 11. The cable reeling drum 17 and cable length sensor 19 are well known in the art. One example of an automatic cable reeling drum with a length sensing capability incorporated therein is the MCP/200 Series System manufactured by H. J. Tinsley and Company, Ltd.

Base boom member 7 also has a processor unit shown schematically at 21 mounted thereon. An angle sensor 23 is attached to and in electrical communication with the processor unit 21. The angle sensor 23 generates an electric signal which is indicative of the angle of elevation of the base boom member 7 with respect to the crane base portion 3. The angle sensor 23 used is well known in the art and one such sensor is sold under the trademark "ACCUSTAR" and is manufactured by Lucas Sensing Systems, Inc.

A main hydraulic cylinder 25 connects the base portion 23 to the base boom member 7, and is used to raise and lower the boom structure. The hydraulic cylinder 25 consists of a cylinder 27 and a piston rod 29.

Figure 3:
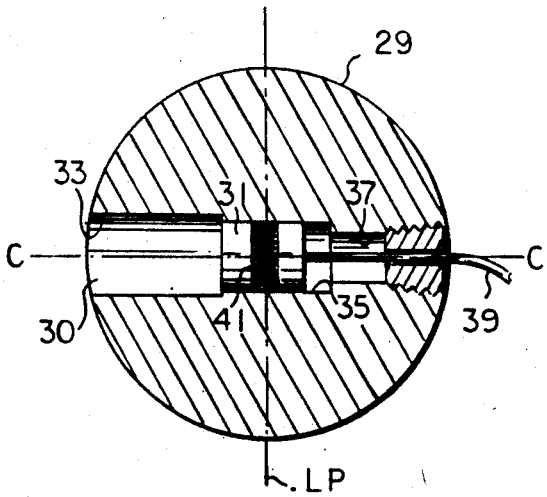
FIG. 3 is a view taken through Section 3—3 of FIG. 2, rotated 90°.
Figure 4:
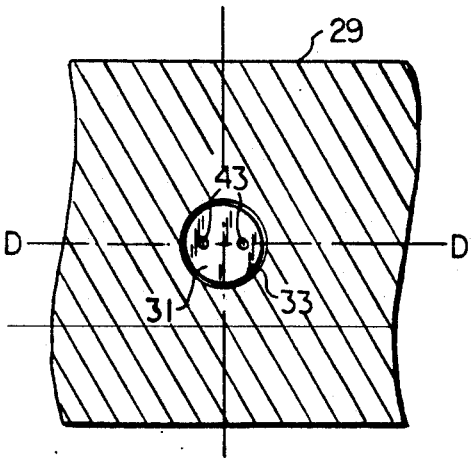
FIG. 4 is a view taken through Section 4—4 of FIG. 2.

Referring to FIGS. 3-4, centrally embedded within a bore hole 30 in the piston rod 29 is a strain sensor 31. The strain sensor 31 detects deformations in the bore hole 30 when the piston rod 29 is subjected to the force of the load 15. The strain sensor 31 then generates an electrical signal to the processor unit 21 which is indicative of the weight of the load 15.

Although the piston rod 29 is shown solid in the application drawing, it will be understood that partially or completely hollow pistons with partially or completely solid end support sections could also utilize the invention concepts. In such structure, the strain sensor could be embedded in the solid portion of the support section.

Figure 2:
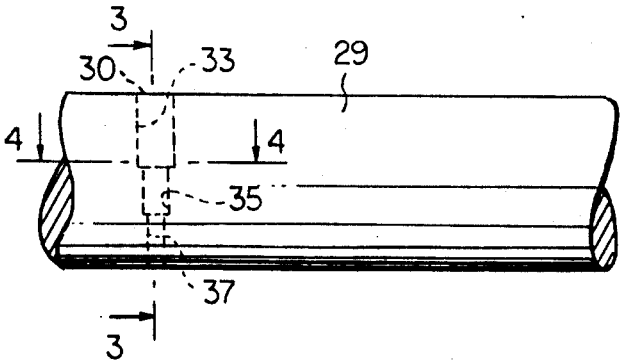
FIG. 2 is a side elevational view of the piston rod in which the strain sensor is located.

Referring to FIGS. 2 and 3, the bore hole 30 comprises two counterbore sections 33 and 35 of varying diameter and concentric with a diametrical axis C—C through the piston. The counterbore 33 allows the strain sensor 31 to be inserted into the piston rod 29 using an insertion tool (not shown), with the strain sensor being press fitted into counterbore 35 preferably without prestressing the sensor. A cable 39, which is connected to the strain sensor 31, exits via a relatively smaller bore 37 and runs to the processor unit 21, thereby electrically connecting the sensor 31 to the processor unit 21. A strain reliever 40 having an axial bore is disposed in bore 37 to reduce the possibility of damage to sensor 31 from tension applied to cable 39. In order to aid the pressing of the strain sensor 31 into the counterbore 35, the strain sensor 31 is typically coated with a "Teflon" grease prior to insertion. The strain sensor 31 also has a knurled portion 41 on its outer periphery which improves the friction fit of the strain sensor 31 within counterbore 35.

The axial center of the sensor is defined as the center of the knurled portion 41, and is aligned such that a longitudinal plane LP passing through the central longitudinal axis of the piston rod 29 also passes through the center of the knurled portion 41.

The specific location of the bore hole 30 in the rod is not critical, with the rod being subjected to substantially uniform pressure over its entire length.

Referring to FIG. 4, the strain sensor 31 has two dimples or small projections 43 in the outer end thereof for ensuring proper alignment of the strain sensor 31 in the counterbore 35. Dimples 43 should preferably be positioned within plus or minus 3° of the load axis D—D, which is the central longitudinal axis of the piston rod 29, in order to achieve optimum results. However, the sensor could be rotated, for example 90°, and a useable signal would still be obtained.

When the strain sensor 31 is mounted as described above, the hydraulic irregularities and non-linearities encountered when attempting to measure cylinder pressure are resolved inside the cylinder and therefore the piston rod 29 and strain sensor 31 are only subject to the forces generated by the load 15 and the weight of the boom components. Therefore, the sensitivity and degree of accuracy of the present invention for determining the load being lifted is much greater than the prior art technique of sensing main cylinder hydraulic pressures.

Moreover, the present strain sensor installation overcomes the major flaw of tensiometers in that it responds immediately to the application of a load on the beam and therefore there is no lag time associated with this installation when determining the weight of the load. Thus, it is possible to sense an extreme overload and stop the machine before the structurally damaging load leaves the ground. In addition, there is no need for the operator to input into the system the number of lines reeved around the hook block and sheaves, thus eliminating a potential source of error for the system.

Furthermore, since the strain sensor 31 is mounted in the piston rod 29, there is no need for an expensive cable reel or radio transmission device to send the strain sensor signal to the processor unit 21, as required for many of the weight determining devices discussed above. This is because the strain sensor 31 is located much closer to the processor unit 21 and connected thereto by a single cable length.

In addition, when the strain sensor 31 is located as described in the preferred embodiment, the weight of any additional items attached to the boom, jibs, or work baskets, is automatically detected by the strain sensor 31. On the other hand, where a load shackle, for example, is used, the operator would have to remember to derate the maximum lifting capacity by the weight of each additional item in order to ensure that the proper maximum lifting capacity was calculated.

The fact that the strain sensor 31 is installed in the center of the piston rod 29 is also important in that temperature gradients between the sensor and the surrounding metal are minimized. Such temperature gradients can cause erroneous error indications and can be created, for example, if the sensor is mounted on the external surface of the piston rod 29 and exposed to direct sunlight. Additionally, by placing the sensor 31 in the center of the piston rod 29, the strain sensor 31 is precluded from erroneously measuring any side loading on the boom such as that created by the wind.

A last important feature of the strain sensor 31 is that it can be safely inserted into the piston rod 29 without violating ANSI (American National Standards Institute) safety standards for the lift cylinder. Therefore, a major redesign of the whole crane structure is not required.

Figure 5:
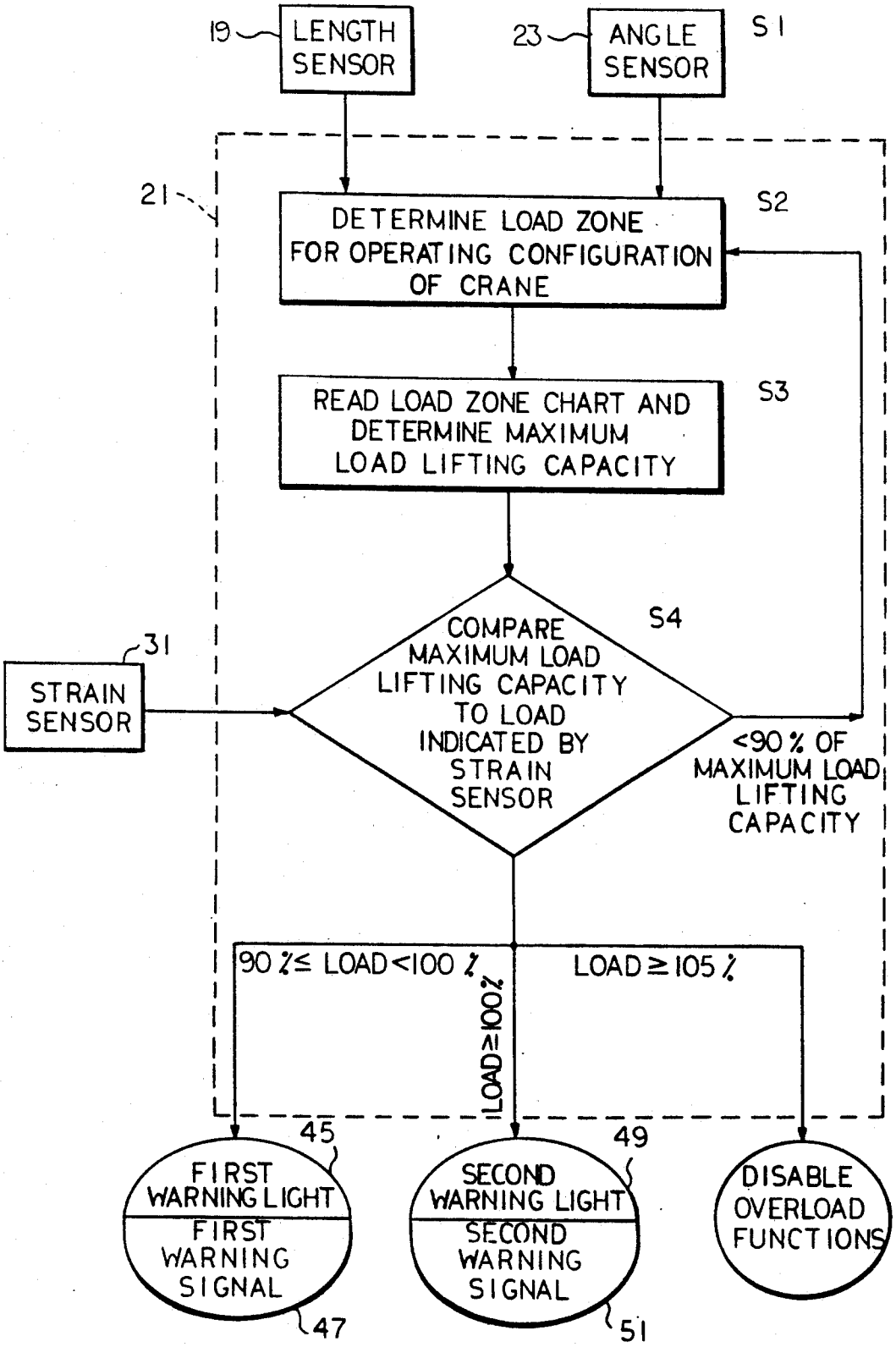
FIG. 5 is a functional flow diagram of the program of the processor.

The operation of the LMI system in accordance with the invention will now be described with reference to FIG. 5. When the crane 1 lifts the load 15, the cable length sensor 19 and the angle sensor 23 provide signals to the processor unit 21 as noted in step S1. In step S2, the processor unit 21 determines the radius from the center of rotation of the boom to the hook block and proceeds to identify a specific load zone in which the crane 1 is operating based on the calculated radius and the boom length. In step S3, the processor unit 21 reads a load zone chart which is stored in memory. The load zone chart identifies discrete load zones for specific combinations of boom length and radius. Each load zone has a maximum load lifting capacity associated with it. Thus, the processor unit 21 reads the corresponding maximum load lifting capacity from the load zone chart, and in step S4, compares this value to the load indicated by the signal received from the strain sensor 31. If the load indicated by the strain sensor 31 is, for example, less than 90% of the maximum load lifting capacity, the program returns to step S2. If the load indicated by the strain sensor 31 is greater than or equal to 90%, and less than 100% of the maximum lifting capacity, a first warning light 45 and a first horn 47 are turned on. If the load indicated is greater than or equal to 100%, a second warning light 49 and second horn 51 are turned on. Finally, if the load indicated is greater than or equal to 105%, the overloading functions of telescoping the boom out, winching the load up, and lowering the boom will all be disabled. Obviously, the specific percentages of maximum load lifting capacity can be varied as desired, and can be more or less than the 90% and 105% indicated by way of example.

An important advantage of dividing the load chart into discrete zones is that the processor unit 21 does not have to calculate as a continuous function the maximum lifting capacity for every point in space based on the crane's configuration. Rather, the computer only needs to determine which zone the machine is operating in. Thus, as long as the crane 1 is operating in that zone, there is only one maximum lifting capacity which the current load needs to be compared to until the crane moves into another zone of the load chart. This greatly reduces the computational load of the processor unit 21.

Although processor unit 21 illustrated is preferred in the system disclosed, it will be understood that for more basic lift equipment, less sophisticated controls may be satisfactory. For example, in a single arm boom lift with a single rated capacity, a sensor and analog comparator for providing a comparison value triggering overload signaling of such type might be sufficient. In other words, the strain sensor of the invention can be utilized with a wide variety of equipment and controls, for the same purpose of preventing structural failure or tipping.

Similarly, with more complex equipment, more sophisticated controls may be desired. For example, it may be advantageous to measure boom orientation or position of rotation, the angularity of additional boom members or the length of these members. In such event, stored values for these features would be compared to measured values during operation. Where the equipment is provided with a main boom and an outer auxiliary boom, strain sensors may be mounted in the lifting pistons of either or both booms to more precisely measure the load on each piston.

While specific embodiments of the invention have been described, it will be understood that the invention is capable of modification and can be used with lift equipment of other types, including pneumatic lift cylinders or linear actuators. In the latter, the strain sensor would be embedded in a solid portion of the actuator's longitudinally movable load member which is comparable to a piston. This application is intended to cover any variations, uses, or adaptations of the invention, following, in general, the principles of the invention and including such departures from the present disclosure as to come within knowledge or customary practice in the art to which the invention pertains, and as may be applied to the essential features hereinbefore set forth and falling within the scope of the invention or the limits of the appended claims.

What is claimed is:

1. In a crane having a load bearing cable, a base, a boom pivotally mounted to said base, and a hydraulic cylinder having a cylinder and a piston rod for raising and lowering said boom, a load moment indicator system comprising:

means for generating a first signal which is indicative of an angle between said boom and said base;

means for generating a second signal which is indicative of a length of said boom;

a strain sensor embedded in said piston rod for generating a third signal which is indicative of the weight of a load which is connected to said load bearing cable;

means for receiving said signals and for determining a maximum load lifting capacity based on said first and second indicative signals; and means for determining if the weight of said load corresponding to said third signal is greater than a predetermined percentage of said maximum load lifting capacity.

2. A load moment indicator system according to claim 1, wherein said strain sensor is centrally embedded in said piston rod.

3. A load moment indicator system according to claim 2, wherein said signal receiving means is a processor unit having a load zone chart in a memory thereof, said load zone chart correlating individual maximum load lifting capacities with specific combinations of said boom angle and said boom length, whereby said processor unit determines said maximum load lifting capacity by reading said maximum load lifting capacity from said load zone chart.

4. A load moment indicator system according to claim 3, further comprising a first warning light and a first horn, wherein when the weight of said load corresponding to said third signal is $\geqq$ to 90% but $<$ 100% of said maximum load lifting capacity, said first light and said first horn are activated.

5. A load moment indicator system according to claim 4, further comprising a second warning light and a second horn, wherein when the weight of said load corresponding to said third signal is ≧ 100% of said maximum load lifting capacity, said second light and said second horn are activated.

6. A load moment indicator system according to claim 5, wherein when the weight of said load corresponding to said third signal is ≧ 105% of said maximum load lifting capacity, whereby the operating functions causing overload are incapacitated.

7. In material handling equipment including support means, a lifting member movable relative to said support means, and a hydraulic cylinder assembly including a cylinder and an at least partially solid piston rod for raising and lowering said lifting member, a load moment indicator system comprising:

a strain sensor embedded in the solid portion of said piston rod for generating a signal indicative of the weight of a load on said lifting member;

means for storing a value representing the said signal maximum load lifting capacity of the lifting member;

means for comparing said signal with said value to determine if the weight of said load as indicated by said signal exceeds a predetermined percentage of said value representing the maximum load lift capacity; and means for providing an output signal based on said predetermined percentage, said output signal providing an alarm signal and/or disabling said lift member depending on such percentage of maximum load lifting capacity.

8. A load moment indicator system according to claim 7, wherein said strain sensor is centrally embedded in said piston rod.

9. A load moment indicator system according to claim 8, wherein said lifting member comprises a pivotally mounted boom having a measurable angle and length, and said means for storing a value is a processor unit having a load zone chart in a memory thereof, said load zone chart correlating individual maximum load lifting capacities with specific combinations of said boom angle and said boom length, whereby said processor unit determines said maximum load lifting capacity by reading said maximum load lifting capacity from said load zone chart.

10. The load moment indicator system of claim 8, wherein said strain sensor is embedded in a transverse bore hole in said rod, said sensor being formed with a knurled exterior surface around its periphery at the longitudinally intermediate portion thereof, said knurled surface being aligned with a first longitudinal plane through said piston rod.

11. The load moment indicator system of claim 8, wherein said strain sensor is mounted in a diametrical bore hole extending transversely through said rod and having a bore hole axis, said bore hole comprising a central bore portion and an outer enlarged counterbore, with said sensor being frictionally mounted in said central bore portion concentric to said bore hole axis, the contacting surfaces of said central bore portion and said strain sensor being so dimensioned that said sensor frictionally fits into said central bore portion.

12. The load moment indicator system of claim 11, wherein a bore portion of smaller diameter than said central bore portion extends therefrom in a direction opposed to said counterbore, a strain relief mounted in said smaller bore portion for receiving and passing without strain lead lines from said strain sensor.

13. The load moment indicator system of claim 10, further including alignment means on the outwardly exposed end of said sensor, wherein said rod has a second longitudinal plane perpendicular to said first longitudinal plane, and wherein said alignment means permits said sensor to be rotated in said bore hole to the optimum orientation relative to said second longitudinal plane.

14. A load moment indicator system according to claim 9, wherein said load zone chart has a plurality of zones, each of said zones having a single specific load lifting capacity associated therewith and being associated with a plurality of specific combinations of said boom angle and said boom length.

15. In material handling equipment including support means, a lifting member movable relative to said support means, and a cylinder assembly including a fixed housing and an at least partially solid longitudinally movable load member mounted in said housing for raising and lowering said lifting member, a load moment indicator system comprising:

a strain sensor embedded in the solid portion of said load member for generating a signal indicative of the weight of a load on said lifting member when in a particular position or zone;

means for storing a value representing when in such position or zone maximum load lifting capacity of the lifting member;

means for comparing said signal with said value to determine if the weight of said load as indicated by said signal exceeds a predetermined percentage of said value representing the maximum load lift capacity; and means for providing an output signal based on said predetermined percentage, said output signal providing an alarm signal and/or disabling the operating functions of said lifting member and/or said load member depending on such percentage of maximum load lifting capacity.

16. A load moment indicator system according to claim 15, wherein said lifting member comprises a pivotally mounted rotatable boom assembly having a measurable angle and length, and said means for storing a value is a processor unit having a load zone chart in a memory thereof, said load zone chart correlating individual maximum load lifting capacities with individual or specific combinations of said boom angle and said boom length and the relative position of said lifting member, whereby said processor unit determines said maximum load lifting capacity by reading said maximum load lifting capacity from said load zone chart.

17. The load moment indicator system of claim 16, wherein said boom assembly comprises a main boom and an auxiliary boom, and longitudinally movable load members in the form of piston-cylinder assemblies operatively connected to each boom, and a strain sensor embedded in the piston of either or both of said piston-cylinder assemblies.

* * * * *